US005322532A

United States Patent [19]

Kurtz

[11] Patent Number: 5,322,532

[45] Date of Patent: Jun. 21, 1994

[54] LARGE SIZE SODIUM BICARBONATE BLAST MEDIA

[75] Inventor: Andrew D. Kurtz, Somerville, N.J.

[73] Assignee: Church & Dwight Co., Inc., Princeton, N.J.

[21] Appl. No.: 75,225

[22] Filed: Jun. 10, 1993

[51] Int. Cl.[5] ..... B24D 3/00

[52] U.S. Cl. ..... 51/293; 51/308; 51/309; 134/7

[58] Field of Search ..... 51/293, 308, 309; 134/7

[56] References Cited

U.S. PATENT DOCUMENTS 4,528,039 7/1985 Rubin et al. ..... 134/2
5,160,547 11/1992 Kirschner et al. ..... 134/7
5,232,514 8/1993 Van Sciver et al. ..... 134/26

*Primary Examiner*—Mark L. Bell
*Assistant Examiner*—Willie J. Thompson
*Attorney, Agent, or Firm*—Charles B. Barris

[57] ABSTRACT

A blast media for stripping contaminants from a substrate comprises abrasive particles which are formed by agglomerating fine particles of sodium bicarbonate with an aqueous binder solution of sodium carbonate to form composite particles of sodium bicarbonate and sodium sesquicarbonate which is formed by the reaction of the bicarbonate with the carbonate in solution.

30 Claims, No Drawings

LARGE SIZE SODIUM BICARBONATE BLAST MEDIA

FIELD OF THE INVENTION

The present invention relates to improvements in blast media utilized to remove adherent material such as paint, scale, dirt, grease and the like from solid surfaces. In particular, the present invention is directed to an improved sodium bicarbonate abrasive blast media which can be used to blast clean solid substrates.

DESCRIPTION OF THE PRIOR ART

In order to clean a solid surface so that such surface can again be coated such as, for example, to preserve metal against deterioration, remove graffiti from stone or simply to degrease or remove dirt from a solid surface, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water, typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to sand as a blast media, particularly, for removing adherent coatings from relatively soft substrates such as softer metals as aluminum, composite surfaces, plastics, ceramic tile, concrete and the like is sodium bicarbonate. While sodium bicarbonate is softer than sand, it is sufficiently hard to remove coatings from any metal surface such as steel or aluminum and as well remove coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has found increasing use in removing coatings and in cleaning dirt, grease and oil and the like from hard surfaces such as steel and interior surfaces such as those which contact food such as in environments of food processing or handling.

Sodium bicarbonate is also a friable abrasive and, like sand, will form a considerable amount of dust during the blast cleaning process. To control the dust formed by the sodium bicarbonate blast media as it contacts the targeted surface, water is included in the pressurized fluid carrier medium. Thus, water can be used as the carrier fluid or, more preferably, injected into a pressurized air stream which carries the blast media from the blast nozzle to the targeted surface. Water as a means to control dust has been mixed with the air stream internally in the blast nozzle or into the air stream externally of the nozzle. The addition of water to the pressurized air stream has been very effective in controlling dust formed by the sodium bicarbonate blast media.

The sodium bicarbonate blast media which has been utilized to remove coatings, dirt, grease, etc. from relatively soft substrates is generally used in the form of particles having a size range of from about 10 to 1,000 microns in diameter. Sodium bicarbonate abrasive particles having a size range of from about 100 to 300 microns have been most widely used as a blast media. Blast media particles of sodium bicarbonate within the upper end of the size range are preferred for most applications inasmuch as flow through the blasting equipment is easier and the mass of the particle is greater such that the force of the particle on the substrate on which it is targeted is greater. The greater force yields greater efficiency in removing the coatings or other contaminants from the substrate surface. Unfortunately, it is difficult to obtain single crystals of sodium bicarbonate having a size range of about 100 microns and greater and, particularly hard to manufacture single crystals of sodium bicarbonate of 300 microns or greater in diameter.

It has been suggested to form an agglomerated particle of sodium bicarbonate for use as a blast media. This agglomerated particle is formed by pressure compacting small particles of sodium bicarbonate into larger particles. These compacted sodium bicarbonate particles are primarily used for removing contaminants from very soft surfaces since the sodium bicarbonate is naturally friable and importantly the pressure compacting does not readily glue the individual sodium bicarbonate particles together. The compacted sodium bicarbonate blast media is very effective for removing contaminants from soft substrates and is disclosed in commonly assigned, copending application U.S. Ser. No. 006,654, filed Jan. 21, 1993.

As above described, sodium bicarbonate blast media is very friable and will be abraded and broken into smaller particles during passage from the supply hopper to the blast nozzle and through the blast nozzle prior to contacting the substrate surface. While the hardness of the sodium bicarbonate is sufficient to allow it to be effective for removing contaminants such as paint, rust, and the like from targeted surfaces, the formation of excessive dust and the relative ease at which the sodium bicarbonate is abraded even before contact with the targeted surface is disadvantageous. Reduced mass of the individual particles and abrasion of the cutting edges of the particles can reduce the cleaning efficacy of the blast cleaning process. The productivity or efficiency of the blast cleaning process can be defined as the volume of contaminant removed from the substrate per time and flow rate of blast media through the nozzle.

Accordingly, it is an object of the present invention to form a sodium bicarbonate blast media having a relatively large particle diameter.

Another object of the invention is to provide an alternative process for forming large particles of sodium bicarbonate for use as a blast media other than forming single crystals of the sodium bicarbonate.

Still another object of the present invention is to form relatively large particles of sodium bicarbonate for use as a blast media which have comparable hardness and density relative to single crystal sodium bicarbonate blast media particles.

SUMMARY OF THE INVENTION

In accordance with the present invention, large particles of sodium bicarbonate blast media and which have good hardness are formed by agglomerating sodium bicarbonate particles in an aqueous soda ash (sodium carbonate) solution as a binder for the particles. Agglomerating the sodium bicarbonate in the presence of the carbonate solution causes the surfaces of the sodium bicarbonate particles to react with the soda ash and form sodium sesquicarbonate. The agglomerated particle which is formed comprises a composite containing individual sodium bicarbonate particles which are bound together via sodium sesquicarbonate bridges. Sodium sesquicarbonate being slightly harder and more dense than sodium bicarbonate enhances the strength and abrasion resistance of the abrasive particle over what has been achieved by mere pressure compacting as in the previously mentioned commonly assigned application. The composite particle is believed to have a hardness comparable to that of the single crystal sodium bicarbonate blast media previously used and is substantially easier to manufacture.

DETAILED DESCRIPTION OF THE INVENTION

The blast media of the present invention will comprise a powdery abrasive which comprises a composite of sodium bicarbonate and sodium sesquicarbonate ($NaHCO_3$. $Na_2CO_3.2H_2O$). The hardness of the composite particle will be less than about 5.0 as is the case with singular sodium bicarbonate particles. The hardness and density of the composite particle is at least comparable to hardness of single crystal sodium bicarbonate particles and substantially easier to manufacture in sizes of at least 200 microns relative to the manufacture of large single crystals. The exact form of the composite will vary depending on the agglomeration method used to form the composite as well as the concentration of binder used and amount of soda ash in solution. Several variations of composite will exist with the major portion comprising particles of sodium bicarbonate held together by sesquicarbonate bridges. A small portion of the composite particles will comprise a sodium bicarbonate core with a uniform or nonuniform coating of sesquicarbonate on the outer edges of the bicarbonate core particle. The composite particles will have a particle diameter of 50 microns or greater, typically from about 100 microns to 1000 microns and, more preferably, from about 200 to 500 microns.

In general, the composite particles are formed by mixing particles of sodium bicarbonate in an aqueous solution of sodium carbonate. The sodium bicarbonate reacts with the sodium carbonate in the aqueous binder solution to form the sesquicarbonate. More specifically, during the agglomeration of the sodium bicarbonate particles with the aqueous binder solution of the sodium carbonate, particles of the bicarbonate stick together upon being wetted by the binder solution. The surfaces of the sodium bicarbonate particles being wetted by the aqueous solution react with sodium carbonate in-situ to form sodium sesquicarbonate. The sesquicarbonate crystal forms especially upon cooling. Agglomeration of the sodium bicarbonate particles with the sodium carbonate solution, thus, yields composite particles comprised of two or more particles of sodium bicarbonate joined together by precipitated sesquicarbonate bridges and this formed composite comprises the bulk of the agglomeration product. As well, individual sodium bicarbonate particles can be coated with the sesquicarbonate if high levels of binder solution are utilized.

In order that the desired reaction of the solid sodium bicarbonate particles and the sodium carbonate in solution may take place and a stable sesquicarbonate crystal be formed, the binder solution should be maintained at a temperature of about ambient, i.e., 20° C., or above and preferably, between about 20°-50° C. After sufficient contact of the sodium bicarbonate particles with the sodium bicarbonate binder solution, the temperature of the solution can be allowed to cool to ambient temperature, if needed, so as to complete the precipitation of the sesquicarbonate crystal which has been formed in-situ. The contact time of the sodium bicarbonate particles with the sodium carbonate solution will depend upon the method of agglomeration used inasmuch as different methods yield different levels of intimate contact between the sodium bicarbonate particles and the sodium carbonate solution.

The sodium bicarbonate particles which are agglomerated with the sodium carbonate solution preferably will have a size of at least about 1 micron and will typically range from about 10 to 300 microns in diameter. The amount of binder solution used relative to the sodium bicarbonate particles will vary depending upon the concentration of the sodium carbonate in solution as well as the type of agglomerating equipment utilized. In general, the sodium carbonate binder solution will be present in amounts of at least about 5 to about 75% by weight relative to the sodium bicarbonate particles and, more preferably, from about 10 to 50% by weight relative to the dry sodium bicarbonate. Soda ash concentration in the solution is also a variable in determining the amount of soda ash binder solution to use during agglomeration. At above 45° C., a soda ash saturated aqueous solution comprises over 30% carbonate. Typically, the composite will comprise from about 1 to 30% of sesquicarbonate. Amounts of sesquicarbonate present in the composite will vary depending upon the relative amount of binder used and concentration of soda ash in solution.

To form the composites of this invention, any known agglomeration method can be used so long as composite particles of the appropriate size are formed. After agglomeration, sieves and even crushing equipment can be used to form and classify the composites into the appropriate size for use as a blast media. Agglomeration may be carried out in any apparatus suitable for the mixing of the dry particulate sodium bicarbonate and adopted so that the liquid sodium carbonate solution is added to the particulates. For example, a bed or falling curtain of sodium bicarbonate particulates may be sprayed or otherwise contacted with the carbonate solution. Any suitable mixing device such as an inclined pan agglomerator, a rotating drum or any other vessel with suitable means of agitation may be used such as horizontal pan mixers, pugmills and other types of intensive agitation devices. Methods of agitating, mixing and agglomerating particulates are well-known to those skilled in the art. The apparatus may be designed or adapted for either continuous or batch operation.

The abrasive blast media particles, comprising composite particles having a diameter of from at least about 50 microns, preferably 200 microns or more, are now free flowing and can be directed against a targeted surface by means of conventional blasting equipment and methods of blast cleaning. In general, a blast cleaning operation involves entraining the abrasive blast particles in a pressurized fluid stream such as water, air, or both and directing said stream through a blast nozzle which accelerates the particles therethrough to the targeted surface. A typical blast nozzle is exemplified by a standard round nozzle which contains a converging conical section, a venturi throat and a diverging conical surface which terminates in an outlet. The venturi effect formed by the juxtaposed conical sections and the venturi throat serves to accelerate the blast media out of the outlet to an extremely high velocity effective to clean or remove adhered coatings, scale, dirt, grease, etc. from the surface being targeted. Thus, a typical air-propelled abrasive blast system includes a blast nozzle that is connected to the outer end of a high pressure flexible supply hose which carries the abrasive blast media mixed with air from a dispensing device to the blast nozzle. A normally closed deadman control valve is mounted adjacent the blast nozzle and functions to prevent operation of the blast nozzle unless the control valve is held open by depressing a spring-loaded lever. Compressed air from a compressor is supplied to the dispensing means, typically a tank or pot, and carries the blast media to the supply hose. The blast nozzle is hand operated and can be moved relative to the targeted surface by the operator.

Other venturi-type blast nozzles can be used including a fan nozzle which is described in commonly assigned, copending application U.S. Ser. No. 979,300, filed Nov. 20, 1992. Instead of conical converging and diverging sections, the inlet portion of the fan nozzle is rectangular in which convergence takes place only between two opposed converging sides. Divergence also takes place from the orifice between only two diverging side surfaces to yield a fan-shaped spray from the outlet. U.S. Ser. No. 979,300 is herein incorporated by reference.

The blast media flow rates through the blast nozzle typically will range from about 0.5 to 15, desirably from about 1.0 to 10.0 lbs per minute and under air pressures from 10 to 100 psi.

It is also useful in accordance with the present invention to include a flow aid or a decaking agent with the blast media. It is important that the abrasive particles remain free flowing inasmuch as such abrasive media are dispensed from the tank or pot which holds the supply of abrasive through various metering valves and eventually through the nozzle by means of the pressurized fluid stream. Particles which are not free flowing will cake, bridge and not be dispersed uniformly throughout the pressurized fluid stream either from the dispensing device or through the nozzle. Most preferably, the flow aid is a hydrophilic silica, hydrophobic silica, hydrophobic polysiloxane or mixture thereof.

Hydrophobic silica, unlike known hydrophilic silicas, is substantially free of non-hydrogen bonded silanol group and absorbed water. One preferred hydrophobic silica which may be utilized in the blasting media hereof is Aerosil R 972, a product which is available from DeGussa AG. This material is a pure coagulated silicon dioxide aerosol, in which about 75% of the silanol groups on the surface thereof are chemically reacted with dimethyldichlorosilane, the resulting product having about 0.7 mmol of chemically combined methyl groups per 100 $m^2$ of surface area and containing about 1% carbon. Its particles vary in diameter from about 10 to 40 nanometers and have a specific surface area of about 110 $m^2$/gram. It may be prepared by flame hydrolysis of a hydrophilic silica as more fully described in Angew. Chem., 72, 744 (1960); F-pS 1,368,765; and DT-AS 1,163,784. Further details respecting such material are contained in the technical bulletin entitled "Basic Characteristics and Applications of AEROSIL", DeGussa AG, August 1986. The hydrophobic silica particles are admixed with the abrasive blasting agent in the proportion of at least about 0.1 and up to about 1.0% by weight thereof. Another hydrophobic silica is Quso, marketed by DeGussa A. G.

Hydrophobic polysiloxanes, preferably non-halogenated polysiloxanes, suitable for use in the blasting media hereof are commercially marketed by Dow Corning and General Electric.

The composite blast media of the present invention as constituted from the agglomerated sodium bicarbonate particles in an aqueous soda ash solution as described above are useful for the efficient cleaning or decoating of any of the substrates which have been previously blast cleaned using sodium bicarbonate media. For example, sensitive metals such as aluminum or aluminum alloys, magnesium or composite substrates, such as utilized on exterior aircraft surfaces, masonry, stucco, plastic, or wood can all be treated. Hard surfaces such as structural steel can also be cleaned. The composite blast media of this invention is also useful to clean interior surfaces, in particular, interior surfaces used in the handling or processing of food. Thus, machinery such as conveying equipment and stainless steel surfaces such as cooking vessels, stainless steel doors or interior storage surfaces can also be cleaned with the blast media of this invention.

EXAMPLE

In this example, composite particles of sodium bicarbonate-sesquicarbonate are formed by fluidized bed. A three-zone fluidized bed is used. Sodium bicarbonate particles of approximately 50 microns in diameter are fluidized in a column with air directed from the bottom of the column. Spray nozzles at the top of the column spray a soda ash solution down onto the fluidized bed of sodium bicarbonate particles. The soda ash solution comprises 30 wt.% sodium carbonate in water and is heated to 50° C. as the solution enters the spray nozzles. The amount of binder solution relative to the sodium bicarbonate particles comprises 10% by weight. In the fluidized bed, the soda ash solution is sprayed onto the sodium bicarbonate particles in the upper agglomerating zone. The wetted bicarbonate particles grow in size in this zone as individual particles stick together. The agglomerated particles are dried in the middle zone and cooled to insure complete precipitation of the sesquicarbonate in the bottom zone. The bottom zone is held at ambient temperature. The composite particles are removed from the bottom of the fluidized bed and comprise particles ranging in size from 100 to 400 microns. At lest 20% of the particles have a size of at least 300 microns. The vast majority of the particles comprise individual particles of the sodium bicarbonate held together by sesquicarbonate bridges. The sesquicarbonate comprises approximately 5 to 10% of the composite particles.

What is claimed is:

1. A process for removing contaminants from a substrate comprising blast cleaning said substrate with a blast media comprising composite abrasive particles formed by agglomerating particles of sodium bicarbonate with an aqueous solution of sodium carbonate, said composite particles comprising sodium bicarbonate and sodium sesquicarbonate.

2. The process of claim 1 wherein said composite abrasive particles have a size range of from about 50 to 1,000 microns in diameter.

3. The process of claim 2 wherein said composite abrasive particles have a size range of from about 100 to 1,000 microns.

4. The process of claim 2 wherein said composite abrasive particles have a size range of from about 200 to 500 microns.

5. The process of claim 1 wherein said composite abrasive particles comprise 1 to 30 wt.% of sodium sesquicarbonate.

6. The process of claim 1 wherein said substrate is metallic.

7. The process of claim 6 wherein said substrate is stainless steel.

8. The process of claim i wherein said substrate is nonmetallic.

9. The process of claim 8 wherein said substrate is a plastic-containing substrate.

10. The process of claim 1 wherein said composite abrasive particles are carried to said substrate in a pressurized air stream.

11. A process for producing a composite abrasive particle useful as a blast media comprising agglomerating fine sodium bicarbonate particles with an aqueous binder solution containing sodium carbonate at a temperature sufficient to allow reaction of said bicarbonate particles with said sodium carbonate so as to form composite particles comprising sodium bicarbonate and sodium sesquicarbonate.

12. The process of claim 11 wherein said composite particles have a size range of from about 50 to 1,000 microns.

13. The process of claim 11 wherein said composite particles have a size range of from about 100 to 1,000 microns.

14. The process of claim 11 wherein said composite particles have a size range of from about 200 to 500 microns.

15. The process of claim 11 wherein the temperature of said binder solution is at least about ambient temperature.

16. The process of claim 11 wherein the temperature of said binder solution is at about 20°-50° C.

17. The process of claim 11 wherein said binder solution is present in amounts of 5 to 75% by weight relative to the weight of said sodium bicarbonate.

18. The process of claim 17 wherein said binder solution is present in amounts of 10 to 50% by weight relative to the weight of said sodium bicarbonate.

19. The process of claim 11 wherein said composite particles comprise from about 1 to 30 wt.% of said sesquicarbonate.

20. The process of claim 11 wherein said fine particles of sodium bicarbonate have a size of at least 1 micron in diameter.

21. A blast media for removing contaminants from substrates comprises composite abrasive particles having a major portion of sodium bicarbonate and a minor portion of sodium sesquicarbonate.

22. The blast media of claim 21 wherein said composite abrasive particles comprise 1 to 30% by weight sodium sesquicarbonate.

23. The blast media of claim 21 wherein said composite abrasive particles have a size range of from about 50 to 1,000 microns.

24. The blast media of claim 21 wherein said composite abrasive particles have a size range of from about 100 to 1,000 microns.

25. The blast media of claim 21 wherein said composite abrasive particles have a size range of from about 200 to 500 microns.

26. The blast media of claim 21 wherein said composite abrasive particles comprise fine particles of said sodium bicarbonate held together by sodium sesquicarbonate bridges.

27. The blast media of claim 21 further comprising a flow aid.

28. The blast media of claim 27 wherein said flow aid is selected from hydrophilic silica, hydrophobic silica, hydrophobic polysiloxanes and mixtures thereof.

29. The blast media of claim 21 wherein said composite abrasive particles are formed by agglomerating fine sodium bicarbonate particles with an aqueous binder solution of sodium carbonate.

30. The blast media of claim 29 wherein said fine sodium bicarbonate particles are at least 1 micron in diameter.

* * * * *